US008806717B2

(12) United States Patent
Scheck et al.

(10) Patent No.: US 8,806,717 B2
(45) Date of Patent: Aug. 19, 2014

(54) LOCKING DEVICE OF A MOTOR VEHICLE FOR SECURING A DISPLACEABLE MOTOR VEHICLE COMPONENT

(75) Inventors: Georg Scheck, Weitramsdorf (DE); Alwin Macht, Ebensfeld (DE); Hans-Ullrich Karsch, Grub am Frost (DE); Steffen Brosius, Weitramsdorf (DE); Sebastian Heinze, Sachsenbrunn (DE); Andre Schade, Bamberg (DE)

(73) Assignee: Brose Fahrzeugteile GmbH & Co. KG, Coburg (DE)

( * ) Notice: Subject to any disclaimer, the term of this patent is extended or adjusted under 35 U.S.C. 154(b) by 664 days.

(21) Appl. No.: 12/668,648

(22) PCT Filed: Jul. 9, 2008

(86) PCT No.: PCT/EP2008/058928

§ 371 (c)(1),
(2), (4) Date: Mar. 17, 2010

(87) PCT Pub. No.: WO2009/007400

PCT Pub. Date: Jan. 15, 2009

(65) Prior Publication Data

US 2010/0192328 A1 Aug. 5, 2010

(30) Foreign Application Priority Data

Jul. 10, 2007 (DE) ..... 20 2007 009 824 U

(51) Int. Cl.
*E05D 11/02* (2006.01)

(52) U.S. Cl.
USPC ..... 16/274; 16/337; 16/342; 16/82

(58) Field of Classification Search
USPC ..... 16/82, 273, 274, 319, 337, 341, 342
See application file for complete search history.

(56) References Cited

U.S. PATENT DOCUMENTS 540,764 A * 6/1895 Spring ..... 16/340
620,999 A * 3/1899 Wambsgans ..... 16/274

(Continued)

FOREIGN PATENT DOCUMENTS

DE 21 14 491 A 10/1971
DE 78 18 814 U1 11/1978

(Continued)

OTHER PUBLICATIONS

International Search Recport, dated Oct. 24, 2008, corresponding to PCT/EP2008/058928.

(Continued)

*Primary Examiner* — Jeffrey O Brien
(74) *Attorney, Agent, or Firm* — Christie, Parker & Hale, LLP

(57) ABSTRACT

A locking device for securing a motor vehicle component which is displaceable relative to a motor vehicle structure and which may be secured by means of the locking device within a displacement range in a respective position of rest reached by displacement is provided. The locking device comprising at least one first frictional element and at least one second frictional element, which is moved relative to the first frictional element upon displacement of the motor vehicle component and thereby may slide with a friction surface along a friction surface of the first frictional element under sliding friction conditions and which, in a respective position of rest of the motor vehicle component, with its friction surface bears against the friction surface of the second frictional element under static friction conditions. A flowable additional medium is provided which may be brought, upon a relative movement of the frictional elements, between their friction surfaces.

12 Claims, 7 Drawing Sheets

(56) References Cited

U.S. PATENT DOCUMENTS

| | | | | | |
|---|---|---|---|---|---|
| 1,004,237 | A * | 9/1911 | Brandes | 16/340 |
| 1,956,040 | A * | 4/1934 | Meyer | 16/340 |
| 2,051,428 | A * | 8/1936 | Tatlow | 16/273 |
| 2,862,229 | A * | 12/1958 | Bacca | 16/342 |
| 3,837,042 | A | 9/1974 | White | |
| 4,186,905 | A * | 2/1980 | Brudy | 16/342 |
| 4,620,344 | A * | 11/1986 | Lewis, Jr. | 16/337 |
| 5,239,731 | A * | 8/1993 | Lu | 16/340 |
| 5,333,356 | A * | 8/1994 | Katagiri | 16/340 |
| 5,799,371 | A * | 9/1998 | Lin | 16/330 |
| 5,906,010 | A * | 5/1999 | Suzuki | 16/342 |
| 5,996,132 | A * | 12/1999 | Sorimachi | 16/303 |
| 6,101,676 | A * | 8/2000 | Wahl et al. | 16/342 |
| 6,178,597 | B1 * | 1/2001 | Suzuki et al. | 16/330 |
| 6,381,808 | B1 * | 5/2002 | Kida | 16/340 |
| 6,408,485 | B1 * | 6/2002 | Wu | 16/342 |
| 6,568,034 | B2 * | 5/2003 | Cho | 16/337 |
| 6,594,858 | B1 * | 7/2003 | Kremer | 16/332 |
| 6,745,396 | B1 * | 6/2004 | Landis et al. | 16/324 |
| 7,261,272 | B2 * | 8/2007 | Courbon | 248/475.1 |
| 2001/0052167 | A1 * | 12/2001 | Cho | 16/337 |
| 2002/0112319 | A1 * | 8/2002 | Kida | 16/342 |
| 2004/0055110 | A1 * | 3/2004 | Breed et al. | 16/82 |
| 2006/0168757 | A1 | 8/2006 | Duning et al. | |

FOREIGN PATENT DOCUMENTS

| | | | | |
|---|---|---|---|---|
| DE | 31 26 841 | C2 | 2/1983 | |
| DE | 87 07 746.9 | | 8/1987 | |
| DE | 88 05 243.5 | | 7/1988 | |
| DE | 40 34 296 | A1 | 4/1992 | |
| DE | 4212181 | A1 * | 10/1993 | E05D 7/086 |
| DE | 42 19 468 | A1 | 12/1993 | |
| DE | 198 38 820 | A1 | 3/2000 | |
| DE | 199 01 263 | A1 | 7/2000 | |
| DE | 100 36 766 | A1 | 3/2002 | |
| DE | 101 21 977 | A1 | 11/2002 | |
| DE | 202 01 320 | U1 | 3/2003 | |
| DE | 602 12 979 | T2 | 3/2003 | |
| DE | 202 12 581 | U1 | 2/2004 | |
| DE | 103 05 977 | B4 | 9/2004 | |
| DE | 103 30 162 | A1 | 1/2005 | |
| DE | 103 34 198 | A1 | 3/2005 | |
| DE | 20 2005 000 982 | U1 | 5/2005 | |
| DE | 20 2004 003 546 | U1 | 8/2005 | |
| DE | 10 2004 034 247 | B3 | 1/2006 | |
| DE | 10 2005 017 929 | A1 | 10/2006 | |
| DE | 20 2006 001 342 | U1 | 2/2007 | |
| DE | 602 12 979 | T2 | 2/2007 | |
| DE | 10 2005 046 868 | A1 | 4/2007 | |
| DE | 10 2006 016 670 | A1 | 10/2007 | |
| EP | 1 375 803 | A1 | 1/2004 | |
| EP | 1 457 630 | A2 | 9/2004 | |
| JP | 2004-332461 | | 11/2004 | |
| WO | WO 02/23000 | A1 | 3/2002 | |

OTHER PUBLICATIONS

English translation of International Preliminary Report on Patentability dated Feb. 9, 2010 for corresponding PCT Application No. PCT/EP2008/058928, 10 sheets.

English translation of Chinese Office action dated Apr. 24, 2012 for Application No. 200880024165.5, 14 sheets.

English translation of Chinese Office Action dated Dec. 13, 2012 for Application No. 200880024165.5, 12 sheets.

English translation of Japanese Notice of Rejection dated Nov. 20, 2012 for Application No. 2010-515503, 3 sheets.

* cited by examiner

LOCKING DEVICE OF A MOTOR VEHICLE FOR SECURING A DISPLACEABLE MOTOR VEHICLE COMPONENT

CROSS-REFERENCE TO A RELATED APPLICATION

This application is a National Phase Patent Application of International Patent Application Number PCT/EP2008/058928, filed on Jul. 9, 2008, which claims priority of German Utility Model Application Number 20 2007 009 824.3, filed on Jul. 10, 2007.

BACKGROUND

The invention relates to a locking device of a motor vehicle for securing a displaceable, in particular swivelling or hinged or moveable, vehicle component which is displaceable with respect to a structural assembly of a motor vehicle and which may be continuously secured in a respective displaced state by means of the locking device.

Such a locking device comprises a first structural frictional element as well as a second frictional element associated to the displaceable motor vehicle component which second frictional element, upon displacement of the motor vehicle component, is moved relative to the first frictional element and thereby, under sliding friction conditions, with a friction surface slides along a friction surface of the first frictional element and which, in a position of rest of the displaced motor vehicle component, and under static friction conditions, with its friction surface frictionally bears against the friction surface of the first frictional element.

The capability of the displaceable motor vehicle component of being continuously lockable by means of the associated locking device thereby has not to be necessarily provided in the entire, at most possible adjustment range of the respective motor vehicle component. Thus, it could be quite sufficient if—depending on the specific application—a displaceable motor vehicle component may be merely secured in a partial range of the maximum adjustment range in a respective displaced position by means of the locking device. The range in which the locking device is effective is here also described as displacement range.

The motor vehicle component, which may be continuously secured in a displaced state, may for example be a motor vehicle door (e.g., a side or rear door) or a closing flap (e.g., a front flap or tailgate) of a motor vehicle which can be hinged away from a motor vehicle structure, for example in order to provide access to a vehicle interior in the case of a motor vehicle door or access to a vehicle motor or a trunk in the case of a closing flap. In this context, it may be desired to not swivel the respective motor vehicle component to a maximum possible swivel position, but only to carry out a limited swivelling into a partially opened position with a swivel angle being smaller than in a completely opened position. This may be for example then important if other cars are parked in the vicinity of a motor vehicle, which other cars shall not be damaged upon swivelling of a motor vehicle component. Then, it is necessary to allow the respective motor vehicle component to be secured in its partially swivelled position in such a way that it is not swivelled further just due to a gust of wind or due to a unintentional contact, which could just cause a collision with the adjoining vehicle. For this reason so-called locking devices at motor vehicles are known, cf. DE 10 2004 034 247 B3.

In this context, it is important that such a locking device ensures at the one hand a sufficient smooth movability of a displaceable motor vehicle component, such as a vehicle door, upon opening or closing, but on the other hand secures the respective motor vehicle component in a respective displaced state so reliably that even stronger gusts of wind or such the like do not cause a further displacement.

SUMMARY

The problem underlying the invention is hence to improve a locking device of the initially stated type with regard to the ease of operation and at the same time a reliable securing of a displaceable motor vehicle component.

According to an exemplary embodiment of the invention, a flowable additional medium is associated to the friction surfaces of the two frictional elements, which additional medium may be, upon a movement of the second frictional element with its friction surface along the friction surface of the first frictional element, between said friction surfaces in order to reduce the sliding friction, in particular in such a manner, that the ratio of the static friction to the sliding friction is substantially increased compared to a dry operation of the arrangement without an additional medium.

During a relative movement of the second frictional element with respect to the first frictional element which is caused by the displacement of the motor vehicle component, flowable additional medium may be accommodated between the friction surfaces of the frictional elements, which friction surfaces facing each other and which frictional elements being associated to one other, channels are provided on at least one of the frictional elements, in particular on the moveable second frictional element, which channels for example may be formed by recessed structures of the frictional element. For this purpose, a friction surface of a frictional element may consist of a plurality of spherical sections, which form channels at the places at which they respectively meet. Furthermore, a type of pimpled surface structure of a frictional element and/or grooves, flutes or the like, which extend along a direction of bracing of the frictional elements, and/or grooves, flutes or the like, which in the manner of a screw circumferentially extend, may be provided at the frictional element, and so on.

As friction parings which may be used for the friction surfaces of the two frictional elements, which friction surfaces cooperate with each other, particularly also in combination with an additional or intermediate medium, for example steel for the one and a plastic for the other friction surface or light metal casting on the one hand/plastic on the other hand or plastic/plastic or steel/light metal casting are suitable. Polyamide (PA), polyurethane (PU), polystyrene (PS), polycarbonate (PC), polyoxymethylene (POM), polysulfone (PSU), poly-2,6-dimethyl-1,4-phenylester (PPE), poletheretherketone (PEEK) and acrylic butadiene styrene (ABS) have been thereby principally proven in experiments to be suitable plastics.

As additional or intermediate medium, oil, in particular oils which do not interfere with the plastic or synthetic material used for a friction surface by etching, swelling or the like, as well as emulsions and dispersions based on oil and further paste-like lubricants, such as grease, are suitable. A specific example for an additional medium is flour silicone basis oil with ester additives.

The additional or intermediate medium is thereby advantageously housed in a housing which—as further described below—further serves for the at least two frictional elements, wherein in particular frictional elements may also be provided which are fixed to the housing.

Using a paste-like lubricant as additional or intermediate medium makes a comparatively less effort for sealing the housing necessary than in the case of a oil which is capable of flowing more freely. For the distribution of a paste-like lubricant so-called grease withdrawers, such as wipers, may be provided in order to transport the grease to the surfaces to be greased, particularly the friction surfaces of the frictional elements.

Upon using an oil as additional or intermediate medium amongst others the combinations steel/PA, steel/PEEK and POM/POM for the friction surfaces of the frictional elements, which friction surfaces cooperate with each other, have been proven suitable.

According to an exemplary modification of the invention, at least one of the frictional elements, in particular the second frictional element, is adapted for embedding the additional or intermediate medium, e.g. due to the use of a material in whose molecular structure the medium may be embedded or the use of a porous material in whose capillary structure the medium may be embedded. Furthermore, at least one frictional element, in particular the second frictional element, may comprise a reservoir for the additional or intermediate medium in its interior and may be further provided with an open-pored capillary structure.

According to an exemplary further aspect of the invention, which, however, may be combined without further ado with the aspects of the invention already stated, the two frictional elements may be elastically braced against one another so that their friction surfaces tend to be pressed against one another under the effect of the pre-tensioning, wherein one frictional element is mounted in such a way that it may follow up/be readjusted along the effective direction of the pre-tensioning force with respect to the other frictional element.

Due to the pre-tensioning force, which for example may be applied by an elastic element, by means of magnets or as well via the weight of the displaceable motor vehicle component or another vehicle component, the two frictional elements with their friction surfaces may be braised against one another in a defined manner so that by using the different magnitudes of a sliding friction on the one hand and a static friction on the other hand—depending on the materials used for the friction surfaces of the frictional elements—on the one hand a displacement of said motor vehicle component as smooth as possible is permitted under the influence of a sliding friction at the locking device and on the other hand the locking device secures the motor vehicle component in displaced position as reliably as possible under the influence of a static friction at the locking device. The respective material for the friction surfaces of the two frictional elements, which friction surfaces cooperate with each other, is hence selected in such a way that the static friction between the friction surfaces of frictional elements associated to one another is substantially greater than the sliding friction, in order to permit smooth running upon displacement of the motor vehicle component on the one hand and its reliable securing in displaced position on the other hand. For this purpose—as stated above—different material combinations for the cooperating friction surfaces of the locking device are provided which furthermore may be combined with a flowable additional or intermediate medium.

Since at least one frictional element is mounted in such a way that it may be readjusted along the effective direction of the pre-tensioning force with respect to the other friction element, it may be ensured, under the effect of the pre-tensioning force and by utilizing the mounting of said frictional element through which mounting it may be readjusted, that even after a long period of operation of the locking device at a motor vehicle the desired friction conditions are always maintained because the friction surfaces of the two friction elements are permanently pressed against each other with a defined pre-tensioning force. Thereby, it is achieved, due to the capability of the one friction element to may follow up along the effective direction of the pre-tensioning force, that the frictional elements may be brought into contact with each other for generating desired friction forces.

Thereby, the one frictional element is in particular mounted moveably with respect to the other frictional element along the effective direction of the pre-tensioning force in such a way that the other frictional element, under the effect of the pre-tensioning force, may be automatically readjusted for generating mostly constant friction conditions. In this respect, appropriate guiding means may be provided for a defined guiding of the one frictional element along the effective direction of the pre-tensioning force.

For the generation of a pre-tensioning force, in particular of an elastic pre-tensioning force, an elastic element, such as in form of a spring such as a pressure or tension spring, flexible spring may serve according to an embodiment of the invention, which spring acts on at least one of the two frictional elements. Examples for suitable springs are coil or disk springs as well as a rubbery-elastic element.

On the other hand, also magnetic forces for the generation of the pre-tensioning force may be used, for instance as one frictional element at least particularly consists of a magnetic material, such as a magnet bound by a plastic, or is connected to an element of such material, and the other frictional element at least partially consists of a material which conducts the magnetic flux generated by the magnetic material or is connected to an element of such material.

Furthermore, also weights, for example the weight of the displaceable vehicle component itself, may be used for generating a pre-tensioning force by means of which the two fictional elements are braised against one another.

According to an exemplary modification of the invention, a housing is provided in which the two frictional elements are arranged, wherein in particular one of the two frictional elements may be arranged securely on the housing and the other frictional element movably with respect to the housing in such a way that the two frictional elements, upon displacement of the associated motor vehicle component, are moveable relative to each other and their friction surfaces thereby slide on one another. The housing may be arranged for example on the vehicle structure, whereas the frictional element being moveable relative to the housing is associated to the displaceable motor vehicle component. The arrangement of one friction element in a manner that it is secured to the housing thereby does not mean that the respective frictional element has to be necessarily arranged rigidly on the housing; in fact an arrangement with play or an elastic arrangement on the housing may be provided for, for instance in order to permit a readjusting under the effect of the pre-tensioning of the elastic element.

The second frictional element associated to the displaceable motor vehicle component may be coupled to said motor vehicle component via a coupling mechanism in such a way that it is turned about an axis upon displacement of the motor vehicle component, or there may be provided for a sliding movement of the second frictional element upon a displacement of the motor vehicle component.

Further, there may be provided for that the friction surfaces of the two frictional elements are inclined to the effective direction of the pre-tensioning force at an acute angle, so that, depending on said angle (i.e., a wedge angle), a force intensification occurs according to the wedge principle. In the case of a rotationally symmetrical design of the frictional elements and the corresponding friction surfaces, in particular with respect to an axis of rotation of the second frictional element, the friction surfaces associated to one another may be for example in each case formed conically.

According to another exemplary embodiment, the friction surfaces of the two frictional elements, which friction surfaces cooperate with each other, respectively extend perpendicular to the effective direction of the pre-tensioning force. The frictional elements then in each case for example may be formed like a disk.

Using a wrapped spring for the second frictional element this one at the same time also takes on the generation of the necessary pre-tensioning force so that separate means for generating said pre-tensioning may be omitted.

According to an exemplary modification of the invention, several frictional elements may be provided for, which respectively cooperate in pairs via friction surfaces associated to one another. For this purpose, at least two pairs of friction surfaces may be also braised against one another along different, in particular opposing directions.

If the second frictional element associated to the displaceable motor vehicle component is coupled to the latter via a gearing, specific transmission ratios, which may be pre-determined, may be established thereby, in particular for the increase of the motion speed of the second frictional element, and/or constructionally caused distances between an output element of the displaceable motor vehicle component and the second frictional element may be bridged, and/or a deflection of the direction of movement of the second frictional element may be carried out with respect to an activating displacement (e.g., a deflection movement) of the corresponding motor vehicle component.

According to a specific embodiment, the second frictional element is arranged on a shaft in a substantially torque-proof manner except for an optionally necessary angular play, e.g. caused by an elastic mounting, i.e. in a manner so that it rotates with the shaft, which shaft, as a part of a coupling mechanism between the displaceable motor vehicle component and the second frictional element, is turned upon displacement of the motor vehicle component, wherein the pre-tensioning force acts along the direction of extent of the shaft and the second frictional element is movably mounted along that direction on the shaft, e.g. via a key and slot joint or another positive connection which indeed allows for a limited longitudinal movement of the second frictional element along the shaft, but not a free rotational movement of the frictional element about the shaft's axis.

In addition to the previously mentioned applications of the invention on motor vehicle doors, front flaps or tailgates and other components associated to the motor vehicle body, a locking device constructed in accordance with the invention may be also used for securing a plurality of other motor vehicle components such as a manually adjustable load floor or a manually adjustable blind which comprises an elastically pre-stressed winding device and which shall be lockable in different positions unwound from the winding device. A further application relates to the utilization of a locking device in accordance with the invention as chocking device at electric drives, e.g. for window lifters, seat adjustments, door adjustments, load floor adjustments etc. Hereby, a self-locking design of such drives can be omitted, if the blocking of forces or torques induced on the output-side are taken on by a locking device which for this purpose is provided for. Thereby, improvements on the degree of efficiency of said drives may be achieved. In general, the locking device in accordance with the invention may hence be applied on any motor vehicle components which are displaceable through movement and which shall be secured in a specific displaced position.

Consequently, the structural assembly of the motor vehicle with respect to which the motor vehicle component is to be displaced, or the structural assembly of the motor vehicle with respect to which a first frictional element, not being moveable together with the displaceable motor vehicle component, is to be secured, has not necessarily to be a component of the motor vehicle body. In fact, a basis, e.g. in the form of a housing, may generally serve for this purpose at which basis the first frictional element of the locking device may be directly or indirectly via further elements arranged and with respect to which the second frictional element is moveable in such a way that the second frictional element is moved with respect to the first frictional element upon a displacement of the motor vehicle component associated to the locking device.

An arrangement of the first frictional element at the structure thereby thus not necessarily mean that said frictional element has to be rigidly fixed at the respective structural assembly of the motor vehicle. In fact, a resilient mounting or a mounting, which is moveable along the pre-tensioning of an elastic element in a limited manner, can for example be provided for.

The dimensioning, i.e. the selected size of the friction surfaces of the two frictional elements, of a possible wedge angle of the friction surfaces and of the pre-tensioning force which is exerted on the second frictional element, as well as the selection of the material of the cooperating pairs of friction surfaces and of the flowable intermediate medium is carried out in dependence on the technical requirement in each individual case, i.e. for instance in dependence on hydrodynamic conditions as well as feasible surface pressures and wear parameters.

BRIEF DESCRIPTION OF THE DRAWINGS

Further details and advantages of the invention will become apparent upon the description of the following exemplary embodiments on the basis of the figures.

DETAILED DESCRIPTION

Figure 8A:
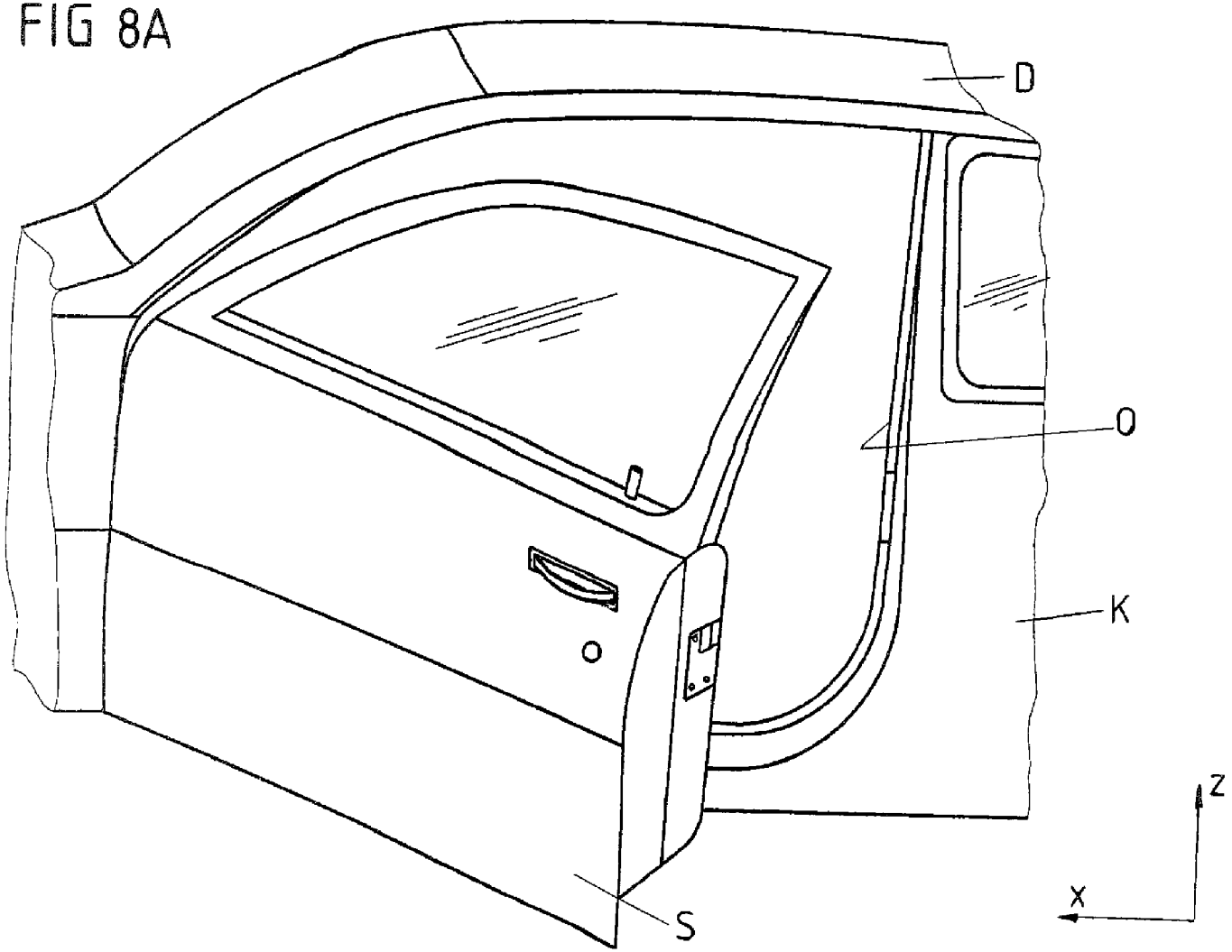
FIG. 8*a* shows a perspective view of a lateral vehicle structure of a motor vehicle with an opened vehicle door.

FIG. 8*a* shows a detail of a lateral vehicle structure (body K) of a motor vehicle which, together with a roof section D of the motor vehicle, defines and encloses a door opening O trough which a passenger may enter the interior of the motor vehicle. For closing the door opening O, a displaceable or deflectable motor vehicle component in the form of a hinged side door S is provided for, which in FIG. 8*a* is depicted in a partially opened position. A hinging of a side door S of a motor vehicle away from the vehicle structure K into a merely partially opened position is regularly carried out for example then when another vehicle is parked next to the motor vehicle so that the side door S can not be opened as wide as liked without colliding with the other vehicle. It is then important that the side door S is secured in the partially opened position in such a way that it is not further opened by a gust of wind or an unintended contact of a pedestrian, since it hereby could collide with an adjoining other vehicle. For this purpose, so-called locking devices are provided for by means of which a side door S may be secured in a partially opened position.

It is an object to design such a locking device in such a way that it on the one hand allows for a reliable securing of a motor vehicle door in a partially opened position, but at the same time does not interfere with a desired smooth movability of the vehicle door upon opening and closing. Different exemplary embodiments of locking devices by means which this object may be achieved will be described in the following on the basis of the FIGS. 1*a* to 5.

Figure 8B:
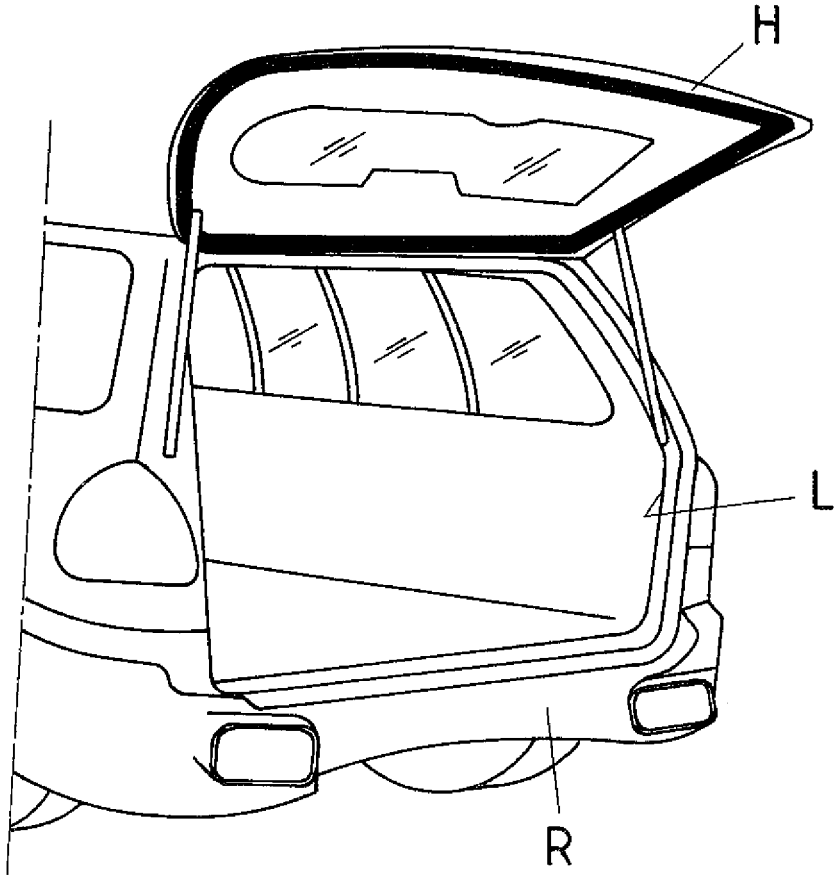
FIG. 8*b* shows a perspective view of a rear side of a motor vehicle with an opened tailgate.

Previously it shall be pointed out on the basis of FIG. 8*b* that locking devices of the mentioned type may not only be provided at side doors of a motor vehicle, but for example as well at a rear door or tailgate H provided at a rear side R of motor vehicle and serving for closing a trunk compartment L. Further possible fields of applications are luggage compartment flaps, motor flaps, sliding doors, adjustable load floorings, blinds or other vehicle components which are displaceable (i.e., deflectable) relative to a structural assembly of a motor vehicle. In the following it will be respectively spoken of deflectable motor vehicle components in general, wherein in particular pivotable or hinged but also slidable motor vehicle components shall be comprised.

Figure 1A:
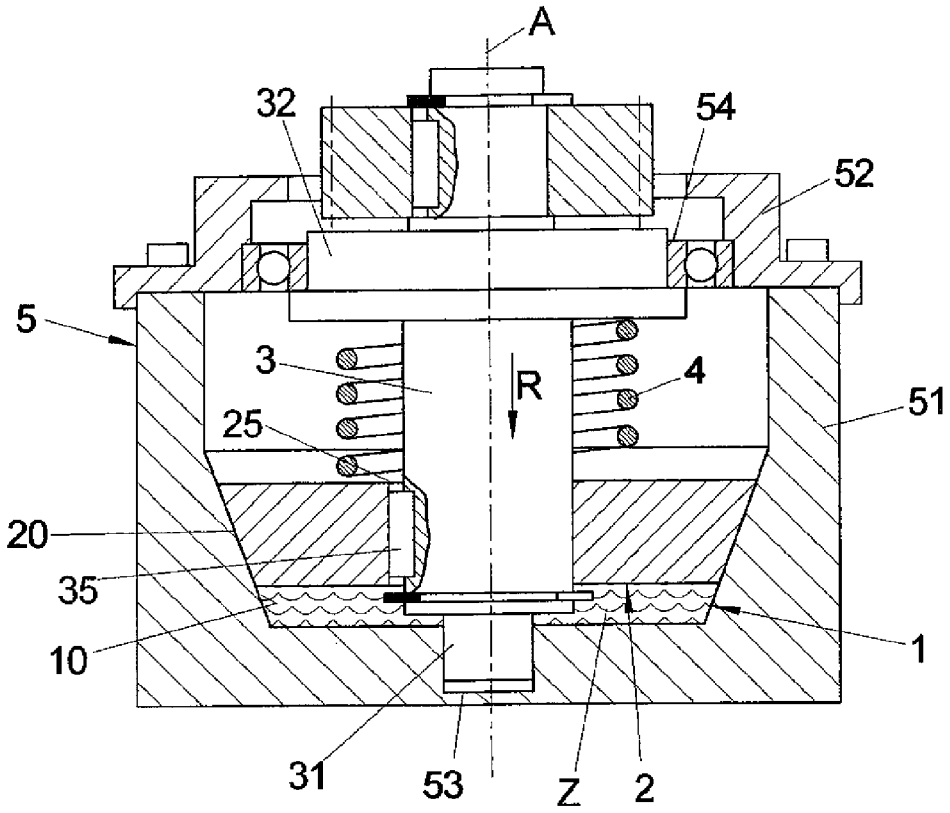
FIG. 1*a* shows a first exemplary embodiment of a locking device for a motor vehicle door in cross-section.

FIG. 1*a* shows in a cross-section a first exemplary embodiment of a locking device by means of which a deflectable motor vehicle component, such as a side door according to FIG. 8*a* or a rear door according to FIG. 8*b* or a sliding door, may be secured in partially deflected position.

The locking device comprises a housing 5 with a housing's bottom part 51 and a housing's top part 52 which are fixed to one another by means of suitable fixing means, e.g. in the form of screws or rivets. In the housing 5 two friction elements 1, 2 are arranged which may be brought into engagement with each other via friction surfaces 10, 20 facing each other, in order to continuously secure a deflectable motor vehicle component in a partially deflected position due to the stiction (static friction) being effective thereby.

The first friction element 1 is formed by a section of the inner wall of the housing 5, to be precise a section of the inner wall of the housing's bottom part 51, which is designed rotation-symmetrically with respect to a housing's axis A and which defines or forms a friction surface 10 of the first frictional element, the friction surface 10 conically tapering towards the bottom of the housing of the housing's bottom part 51. Thus, the first frictional element is constructed in a manner fixed to the housing by forming its friction surface 10, which is rotation-symmetric with respect to the housing's axis A and tapers conically, as an integral part of an inner side wall of the housing 5, which side wall is annularly circumferential. Alternatively, a first frictional element fixed to the housing may be for example also realized by fixing a frictional element, being separate of the inner wall of the housing, in the interior of the housing.

The disk-shaped second friction element 2 is mounted on a shaft 3 in a torque-proof manner, which shaft at its two ends 31, 32 is respectively mounted rotatably in an associated bearing 53 and 54 of the housing 5 and whose pivot axis A coincides with the housing's axis with respect to which the first frictional element 1 is formed rotational-symmetrically. The second frictional element 2 is also designed substantially rotational-symmetrically with respect to said axis A (except for a structuring of its friction surface) and tapers—as well as the first frictional element 1—towards the bottom of the housing being provided at the housing's bottom part 51. Hereby, the second friction element 2 defines a conic friction surface 20 at its outer circumference which conic friction surface lies opposite to the conic friction surface 10 of the first friction element 1 and may be brought into frictional engagement with the latter.

In order to bring the friction surfaces 10, 20 of the two frictional elements 1, 2 into frictional engagement with each other, an elastic element 4 in the form of a spring, to be precise of a coil spring designed as a pressure spring, is provided, which encompasses the shaft 3 and which is supported on the one hand on a widened end section 32 of the shaft 3 and on the other hand on the second frictional element, namely in such a way that it tends to brace the second frictional element 2 against the first frictional element 1 and hereby bring the two friction surfaces 10, 20 into engagement with each other. Expressed in other words, the effective direction R of the forces applied by the pre-tensioned, elastic element 4 or the respective pre-tensioning is such that it extends along the shaft 3 or its axis A, respectively, and braces the second frictional element 2 along said direction R against the first frictional element 1.

In order to permit an axial movability of the second frictional element, which is mounted on the shaft 3 in such a way that it turns with the shaft, so that this one may be brought into engagement with the friction surface 10 of the first frictional element 1 in a defined manner along the effective direction R of the pre-tensioning of the elastic element 4, the torque-proof mounting of the second frictional element at the associated shaft 3 is carried out by means of positive fitting regions 25, 35 of the frictional element 2 and the shaft 3, which positive fitting regions engage into each other and allow for an axial movability of the second frictional element 2 along the axis A of the shaft 3 and thus also the housing's axis coinciding therewith. Precisely, the positive fitting regions 25, 35 here exemplarily form a key and slot joint comprising a groove 25, which is provided at the second frictional element 2 and extends along the shaft's axis A, and comprising an associated spring 35 in the form of a projection, which spring protrudes outwardly from the shaft 3 into the groove 25.

The positive fitting region 35 in the form of a spring, which positive fitting region protrudes outwardly from the shaft 3, engages into the associated positive fitting region 25 in the form of a groove of the second frictional element 2 in such a way that the second frictional element 2 is mounted on the shaft 3 in a substantially torque-proof manner, except for an angular play optionally provided for, but may be moved—under the effect of the pre-tensioning of the elastic element 4—along the axis A in a limited way, wherein the maximum possible extend of the movement is limited in that the second frictional element with its friction surface 20, under the effect of the pre-tensioning of the elastic element 4, is pushed against the associated friction surface 10 of the first frictional element 1.

Due to its axially movable mounting, the second frictional element 2 is capable, under the effect of the pre-tensioning of the elastic element 4, to be automatically readjusted/to follow up in such a way that it—even after a long period of operation of the locking device and the wear related therewith—always engages the associated friction surface 10 of the first frictional element 1 in a defined manner. The readjustment is thereby carried out automatically under the effect of the pre-tensioning of the elastic element 4 and by utilizing the axial movability of the second frictional element 2 along the shaft 3.

The material for the friction surfaces 10, 20 of the two frictional elements 1, 2 has to be selected such that the two friction surfaces 10, 20, when they engage each other under the effect of the pre-tensioning of the elastic element 4, establish a sufficiently strong static friction in order to secure a motor vehicle component, which is partially deflected with respect to the vehicle structure, in its deflected position by means of the locking device. Suitable material combinations for the two friction surfaces 10, 20 have been already mentioned above. In the present case, it may be for example assumed that the two friction surfaces 10, 20 are respectively made up of POM (polyoxymethylene).

In addition to a reliable securing of a deflected motor vehicle component, the locking brake shall furthermore permit a deflecting of the respective motor vehicle component as smooth as possible; i.e. the frictional forces being effective between the two friction surfaces 10, 20 of the frictional elements 1, 2 shall be as small as possible upon a relative movement of the two frictional surfaces 10, 20 relative to each other. Expressed with other words, the sliding friction being effective between the two friction surfaces 10, 20 upon a relative movement shall be significantly less, preferably a less many times over, than the static friction which is effective between the friction surfaces 10, 20 when the second frictional element 2 is braced against the first frictional element 1 by means of the elastic element 4 in a position of rest.

The movement of the second frictional element upon a deflection of an associated motor vehicle component which is to be secured by means of the locking brake, such as a side door or rear door of a motor vehicle, is thereby activated in that the shaft 3, on which the second frictional element 2 is mounted in a torque-proof manner, is coupled with said deflectable motor vehicle component, namely in such a way that a deflection of said motor vehicle component, i.e. for instance a vehicle door, is transformed into a rotational movement of the shaft 3 around its axis A. For this purpose, the shaft 3 on the one hand may affect directly at a swivel axis around which a deflectable motor vehicle component is swivelled, or a gearing may be installed before the shaft 3 via which a deflection of the respective motor vehicle component is transformed into a rotational movement of the shaft. Such a gearing than can for example cause a specific transformation for an increased speed of the second frictional element or also a change of direction, for instance in order to orient the shaft 3 in a certain direction.

As a result, the second frictional element 2 is to be coupled via the corresponding shaft 3 to an associated deflectable motor vehicle component, such as a vehicle door, in such a way that a deflection of said motor vehicle component results in a rotational movement of the shaft 3.

The other first frictional element 1 has than to be fixed with respect to the vehicle structure in such a way that it is not entrained upon a deflection of the motor vehicle component to be secured. This may particularly be achieved in that the housing 5, at who's inner wall the first frictional element 1 with its friction surface 10 is formed, is arranged on the structure at the vehicle, for example at a frame work of a vehicle door associated to the locking device.

Thus, a deflection movement of the deflectable motor vehicle component associated to the locking device in consequence results in that the second frictional element 2 is twisted around the axis A with respect to the first friction element 1 by means of the shaft 3, wherein the two conic friction surfaces 10, 20 slide on one another. Now it is an object to limit the sliding frictional forces being effective thereby—at the same time ensuring static frictional forces as strong as possible—in such a way that no too strong friction forces counteract a deflection of said motor vehicle component. On the one hand, an appropriate selection of the materials used for two cooperating friction surfaces 10, 20 may contribute to this, in particular by using such material pairings at which the static friction is substantially greater, in particular greater many times over, than the sliding friction.

Alternatively or additionally, the use of a flowable additional or intermediate medium Z is in the present case provided for which is to be brought between the friction surfaces 10, 20 of the two frictional elements 1, 2, which friction surfaces face each other, during a movement of the second frictional element 20 relative to the first frictional element 1 and reduces the acting friction forces. As a lubricant for the reduction of the friction forces, a suitable oil, such as flour silicone basis oil with ester additives may be used, namely indeed in combination with friction surfaces 10, 20 which are respectively made up of POM.

The additional or intermediate medium Z in the form of a lubricant, i.e. composed of a flowable material, is provided in the housing's bottom part, namely with such a filling level that it reaches at least to the bottom side of the second frictional element 2, which bottom side faces the bottom of the housing.

Figure 1B:
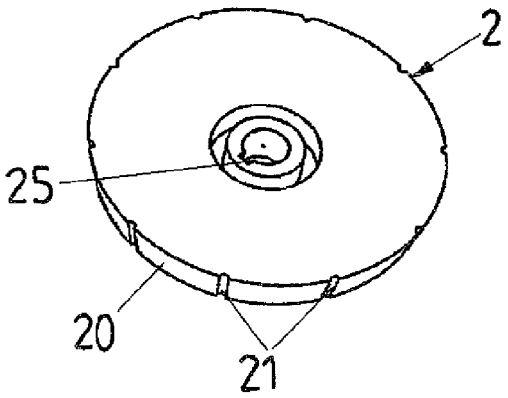
FIG. 1*b* shows a first embodiment of a frictional element for the locking device from FIG. 1*a* in perspective view.
Figure 1C:
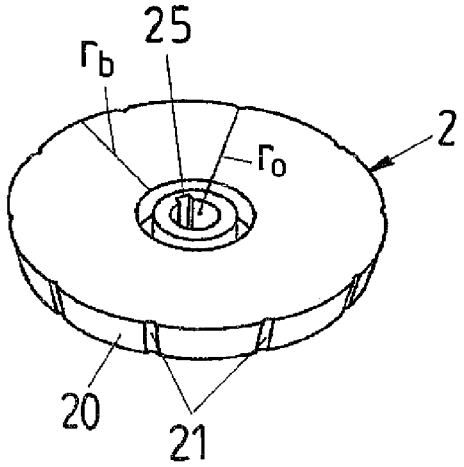
FIG. 1*c* shows a second embodiment of a frictional element for the locking device from FIG. 1*a* in perspective view.

In order that a sufficient portion of the flowable additional or intermediate medium Z may get between the friction surfaces 10, 20 of the frictional elements 1, 2 during a relative movement, i.e. a rotary movement, of the second frictional element 2 with respect to the first frictional element 1 and the sliding friction thereby is accordingly reduced, guiding channels 21 are provided along the friction surface 20 of the second frictional element 2, cf. FIGS. 1*b* and 1*c*, along which guiding channels the additional or intermediate medium may rise during a rotational movement of the second frictional element 2 so that it gets between the two friction surfaces 10, 20.

In the state of rest of the second frictional element 2, i.e. when for instance a deflected motor vehicle component shall be secured in deflected position by means of the locking device, the additional or intermediate medium Z is pressed out from the area between the friction surfaces 10, 20, bearing against one another, under the effect of the pre-tensioning force of the elastic element 4 so that the static friction is not affected.

According to the embodiment of the second frictional element shown in FIG. 1*b*, the channels 21 are formed as recesses (e.g., grooves or flutes) in the friction surface 20 of the second frictional element 2, which recesses substantially extend along the shaft 3 or its axis A, respectively, but which thereby—in accordance with the inclination of the friction surface 20—are inclined to said direction.

At the variant shown in FIG. 1*c*, the friction surface 20 of the second friction element 2 consists of a plurality of spherical portions which are arranged one after the other along the circumferential direction of the disk-shaped frictional element and which for example respectively represent a segment of a circle whose radius $r_b$ is smaller than the radius $r_o$ of the circular path along which the spherical portions are arranged one after the other. Thereby, guiding channels 21 for the flowable additional or intermediate medium Z are respectively formed at the places at which the spherical portions adjoin.

The type and amount of the additional medium Z to be provided for is to be selected advantageously in such a way that, on the one hand, the second frictional element 2 preferably does not swim on it and, on the other hand, the additional medium Z may be urged, as described above, out of the area of the friction surfaces of the friction elements 1, 2, which friction surfaces are associated to each other, in order to permit static friction in the state of rest.

Altogether, the FIGS. 1*a* to 1*c* hence result in the following: If the deflection movement ends which caused the displacement of a motor vehicle component associated to the locking device, such a vehicle door, the shaft 3 does not rotate further and the second frictional element 2 lies stationary opposite to the first frictional element 1, the mutual friction surfaces 10, 20 bearing against one another. Under the effect of the pre-tensioning force generated by the elastic element 4 the intermediate medium Z being present between the two friction surfaces 10, 20 is then pushed away at least at the places at which the friction surfaces 10, 20 directly bear against one another. After a short transition period, which is necessary for pushing the intermediate medium Z away, the increased dry static friction between the two friction surfaces 10, 20 then sets in.

If the respective motor vehicle component is afterwards moved again, for example, in order to deflect it further or in order to swivel it back to its initial position, the static friction between the friction surfaces 10, 20 of the locking device first of all has to be overcome therefor. Once the second frictional element with its friction surface 20 is then again moved with respect to the first frictional element 1 and its friction surface 10, i.e. is turned, it is ensured by means of the guiding channels 21, which upon a rotary movement of the second frictional element bit by bit pass over all regions of the friction surface 10 of the first frictional element 1, that the friction surface 10 of the friction element 1 is continuously wetted with intermediate medium Z, over which the friction surface 20 of the second frictional element 2 then may slide with reduced sliding friction.

Figure 2:
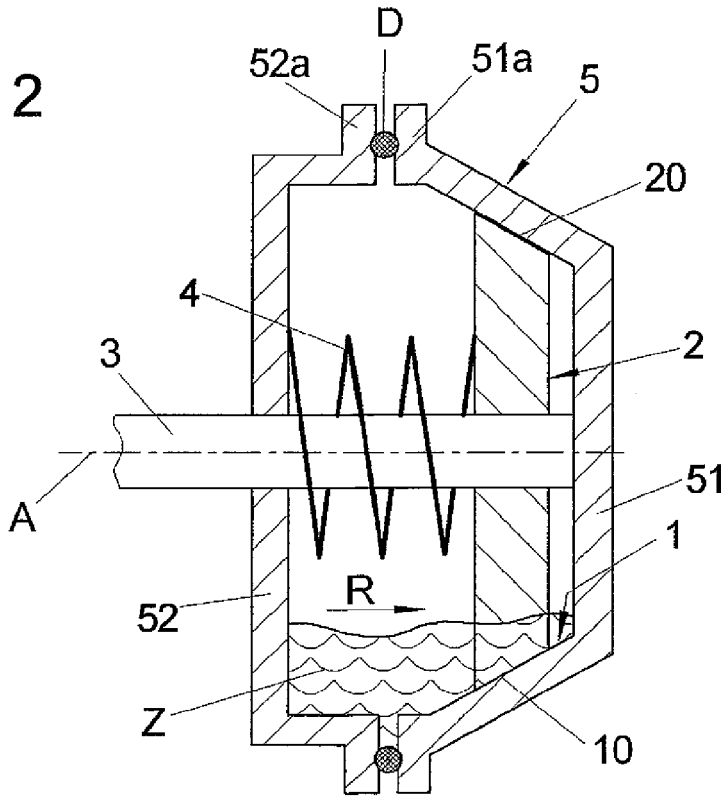
FIG. 2 shows a second exemplary embodiment of a locking device for a motor vehicle door.

FIG. 2 shows an alternative of the embodiment from FIG. 1*a* according to which the housing 5 in its mounting position, i.e. in the position in which it is to be mounted as intended in a motor vehicle, is orientated in such a way that the shaft 3 and its axis A extend horizontally, whereas the shaft 3 and its axis A at the embodiment shown in FIG. 1*a* extend vertically in the mounted position, i.e. for instance along the vertical axis of a motor vehicle.

In the case of the arrangement from FIG. 2, the additional or intermediate medium Z thus accumulates not only in the housing's bottom part 51 (as it is possible at the arrangement from FIG. 1*a*), so that here a sealing of the connecting area between the two housing parts 51, 52 is necessary. For this purpose, the two housing parts 51, 52 bear against on one another via in each case one fixing flange 51*a*, 52*a*, which outwardly protrudes and e.g. is annularly circumferential, namely with the interposition of a seal D between the two fixing flanges 51*a*, 52*a*.

Figure 3:
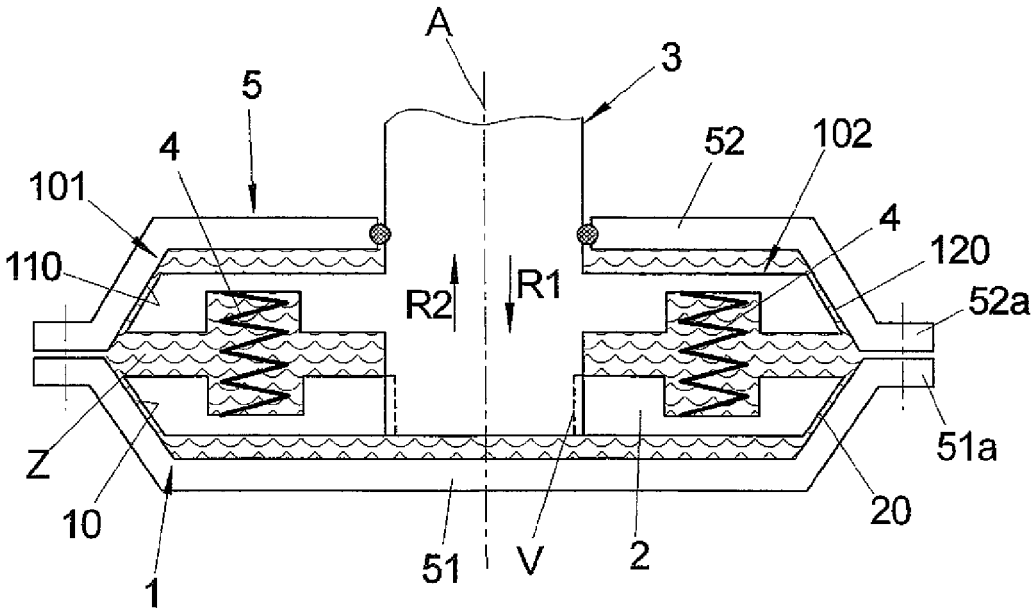
FIG. 3 shows a third exemplary embodiment of a locking device for a motor vehicle door.

FIG. 3 shows a further alternative of the arrangement from FIG. 1*a* according to which two pairs of friction surfaces 10, 20 and 110, 120 are provided along which in each case a first frictional element 1 or 101 being fixed to the housing and a second frictional element 2 or 102 being twistable thereto cooperate. The two frictional elements 1, 101 being fixed to the housing are respectively formed at the inner wall of the housing 5, and indeed, opposing each other, the one first frictional element 1 at the housing's bottom part 51 and the other first frictional element 101 at the housing's top part 52. The frictional element 1 formed at the inner wall of the housing's bottom part 51 thereby tapers conically towards the bottom of the housing and the frictional element 101 formed at the inner wall of the housing's top part 52 tapers conically towards the upper top surface of the housing's top part 52. The two frictional elements 1, 101 being fixed to the housing are hence formed substantially symmetrical with respect to a plane running perpendicular to the axis A of the shaft 3.

In the housing 5, which is formed by the two housing parts 51, 52 and whose housing parts 51, 52 are connected to each other via fixing flanges 51*a*, 52*a* protruding outwardly, are further received two second frictional elements 2, 102 which are respectively associated to one of the first frictional elements 1, 101 or its friction surface 10, 110 formed at the inner wall of the housing 5, respectively. Thereby, the second frictional element 2 associated to the first frictional element 1 of the housing's bottom part is secured in a torque-proof manner at the shaft 3 projecting into the housing 5, as well as in the case of FIGS. 1*a* and 2, via key and slot joint V, which is schematically indicated in FIG. 3, and thereby at the same time is axially movable along the shaft 3 or its axis A, respectively.

The other second frictional element 102 which faces the first frictional element 101 of the housing's top part, in contrast thereto, is fixedly, i.e. for instance integrally, connected to the shaft 3. Both second frictional elements 2, 102 respectively have a conically tapered friction surface 20 or 120 at the outer circumference, which friction surface may be brought into frictional engagement with the respectively associated friction surface 10, 110 of the corresponding first frictional element 1 or 101. For this purpose, at least one elastic element in the form of a pressure spring is arranged the two frictional elements 2, 102 which elastic element tends to push the two second frictional elements 2, 102 in opposing directions R1, R2 along the shaft 3 or its axis A, respectively, apart from one another in such a way that each of the two second frictional elements 2, 102 with its friction surface 20 or 120 is pressed against the friction surface 10 or 110 of the associated first frictional element 1, 101.

An axial movability of the second frictional element 2 of the housing's bottom part is thereby ensured via its longitudinally movable mounting at the shaft 3. The other second frictional element 102 of the housing's top part, in contrast thereto, is rigidly connected to the shaft 3, wherein a movability along the shaft's axis A here is e.g. permitted by mounting the shaft 3 in total movably in axial direction at the housing 5. If necessary, the friction surface pairing 110, 120 of the housing's top part may also be permanently engaged.

By the way, the individual pairs of friction surfaces 10, 20 or 110, 120, as regards their design, are identical to the pair of friction surfaces 1, 2 as illustrated on the basis of FIG. 1*a* so that it is referred to the explanations for FIGS. 1*a* to 1*c* for further details.

Due to the forming of two pairs of friction surfaces 10, 20; 110, 120 at the arrangement shown in FIG. 3 instead of merely one pair of friction surfaces 10, 20 at the arrangements shown in FIGS. 1*a* and 2, a corresponding greater locking force, as sum of the static friction forces being effective at the two pairs of friction surfaces 10, 20; 110, 120, may be achieved with a locking device.

Figure 4:
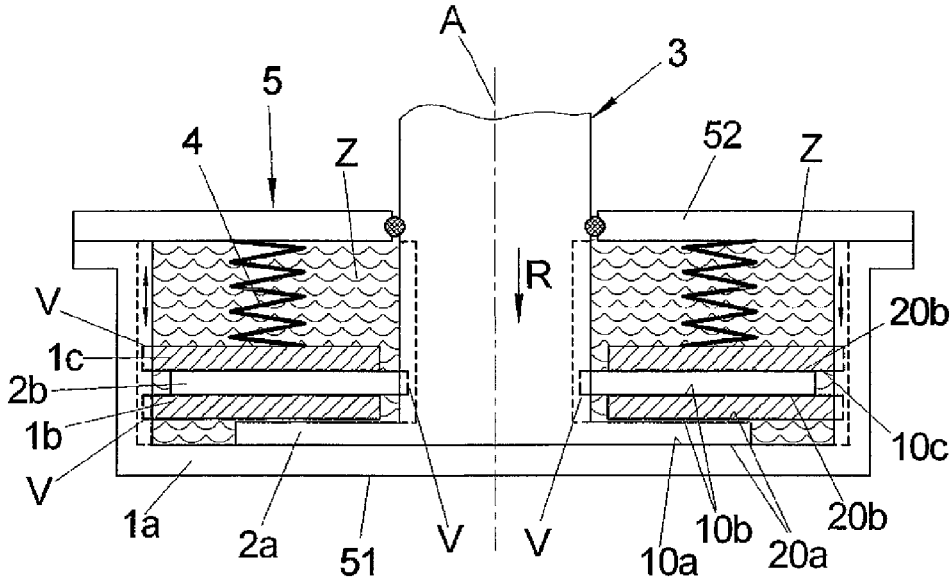
FIG. 4 shows a fourth exemplary embodiment of a locking device for a motor vehicle door.

FIG. 4 shows an alternative of the embodiment from FIG. 1 with three first frictional elements 1*a*, 1*b*, 1*c* fixed to the housing and two second frictional elements 2*a*, 2*b* arranged in a torque-proof manner at the shaft 3, wherein the first and second frictional elements 1*a*, 1*b*, 1*c*; 2*a*, 2*b* are alternately arranged one after the other along the shaft 3 or its axis A, respectively. Not the outer circumferential faces of the disk-shaped frictional elements 1*a*, 1*b*, 1*c*; 2*a*, 2*b* here do thereby serve as friction surfaces, but rather their top and bottom sides 10*a*, 10*b*, 10*c*; 20*a*, 20*b*, so that there is a plurality of friction surface pairings 10*a*, 20*a*; 20*a*, 10*b*; 10*b*, 20*b*; 20*b*, 10*c* at which in each case a friction surface 10*a*, 10*b*, 10*c* of a first frictional element 1*a*, 1*b*, 1*c*, being fixed to the housing, bears against a friction surface 20*a*, 20*b* of a second frictional element 2*a*, 2*b*, being mounted at the shaft 3, in such way that it turns with the shaft, namely under the effect of the pre-tensioning from at least one elastic element 4 in the form of a pressure spring which at the one hand is supported at the housing 5, in particular at its top surface, and on the other hand at a frictional element 1*c*, which is fixed to the housing but is movable in axial direction.

Thereby, only one (1*a*) of the frictional elements 1*a*, 1*b*, 1*c* being fixed to the housing here is formed as a part of an inner housing wall, namely of the bottom of the housing, whereas the two other frictional elements 1*b*, 1*c* being fixed to the housing are in each case movably housed along the shaft 3 or its axis A, respectively, in a side wall of the housing through a key and slot joint V.

One frictional element 2*a* of the two second frictional elements 2*a*, 2*b* is rigidly, in particular integrally, connected to the shaft 3 and the other frictional element 2*b* is arranged axially and longitudinally movably (however, at the same time in a manner so that it turns with the shaft or in a torque-proof manner) at the shaft 3 via a key and slot joint V. A longitudinal movability of the second frictional element 2*a* being integrally formed on the shaft 3 may thereby result from mounting the shaft 3 in total in a limited manner longitudinally movably in the housing 5.

By bracing the outmost upper first frictional element 1*c*, which faces away from the bottom of the housing, in axial direction by means of at least one elastic element 4, taking advantage of the axial movability of the upper first frictional element 1*c*, which is mounted at the housing 5 via a key and slot joint, the pairs of friction surfaces 10*a*, 20*a*; 20*a*, 10*b*; 10*b*, 20*b*; 20*b*, 10*c* are pushed against one another under the effect of the elastic pre-tensioning force in such a way that a desired static frictional force occurs which serves for securing a deflected motor vehicle component in deflected position.

Since here the force intensification due to the wedge effect, as it is present in the embodiments of FIGS. 1*a*, 2 and 3, is omitted, a sufficiently strong locking force in the arrangement shown in FIG. 4 is achieved in that here four pairs of friction surfaces cooperate.

Just one first frictional element 1*a* with its friction surface 10*a* is thereby formed immovably in axial direction at the housing 5, to be precise on the bottom of the housing. All the other frictional elements 1*b*, 1*c* and 2*a*, 2*b* are mounted movably in axial direction, wherein the two first frictional elements 1*b*, 1*c* are mounted longitudinally movably at a side wall of the housing's bottom part 51 via in each case one key and slot joint V and the two second frictional elements 2*a*, 2*b* are longitudinally movably accommodated at the shaft 3 via in each case one key and slot joint V.

Figure 5:
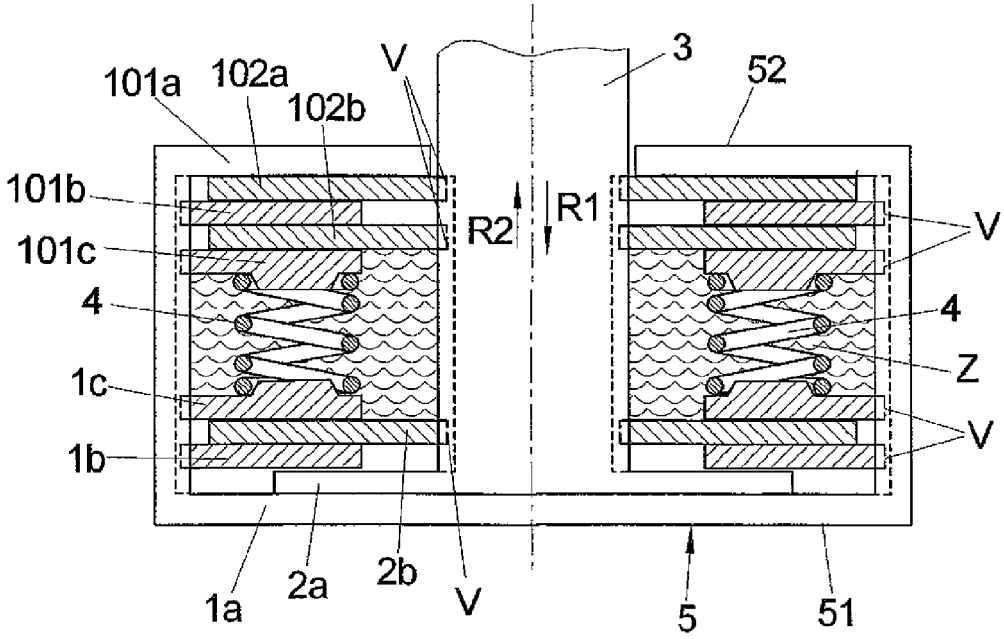
FIG. 5 shows a fifth exemplary embodiment of a locking device for a motor vehicle door.

FIG. 5 shows, in a modification of the embodiment from FIG. 4, a doubling of the arrangement from FIG. 4, i.e. there is respectively provided an arrangement consisting of first and second frictional elements 1*a*, 1*b*, 1*c*; 2*a*, 2*b* or 101*a*, 101*b*, 101*c*; 102*a*, 102*b* at a lower housing part 51 as well as at an upper housing part 52, wherein the two arrangements of frictional elements will be braced by means of elastic elements 4 which, if viewed in axial direction, lie between the two arrangements and brace the two arrangements in directions R1 and R2, opposing each other, in such a way that their friction surfaces are pressed against one another respectively generating a suitably strong friction force, in particular a static friction of the shaft 3 rests and does not turn.

Both in the case of the arrangement from FIG. 4 and in the case of the arrangement from FIG. 5 an additional or intermediate medium Z is respectively arranged in the housing 5 which additional or intermediate medium may be guided between the friction surfaces 10*a*, 10*b*, 10*c*; 20*a*, 20*b* and 110*a*, 110*b*, 110*c*; 120*a*, 120*b* of the frictional elements, which friction surfaces bear against each other, through suitable channels during a rotation of the second frictional elements 2*a*, 2*b* or 2*a*, 2*b*; 102*a*, 102*b* in order to reduce the sliding friction, and which additional or intermediate medium is pressed out of the area between the friction surfaces facing each other when the shafts rests and thus the second frictional elements 2*a*, 2*b* or 2*a*, 2*b*; 102*a*, 102*b* rest, in order to achieve a maximum static friction and thus a locking force of the locking device as strong as possible.

In FIGS. 6*a* to 6*d* differently designed positive fitting regions at a second friction element 2 are shown in cross-section via which the respective disk-shaped second frictional element 2 may be arranged at the shaft 3 in a torque-proof manner but at the same time longitudinally movably, cf. FIGS. 1*a* to 5.

Figure 6A:
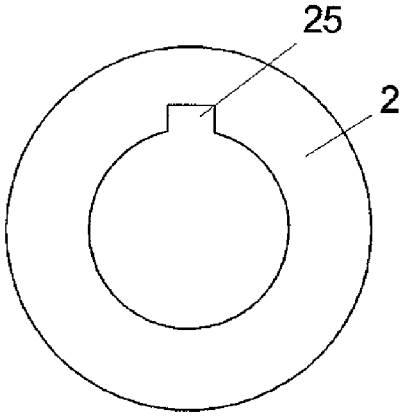
FIG. 6*a* shows a variant for the design of a positive fitting region at a frictional element of the locking device via which the frictional element may be brought in torque-proof and longitudinal moveable engagement with a shaft.

FIG. 6*a* schematically shows once more the design of a positive fitting region 25 known from FIGS. 1*a* to 1*c*, in particular FIGS. 1*b* and 1*c*, as a groove extending along the shaft 3 or its axis A, respectively.

Figure 6B:
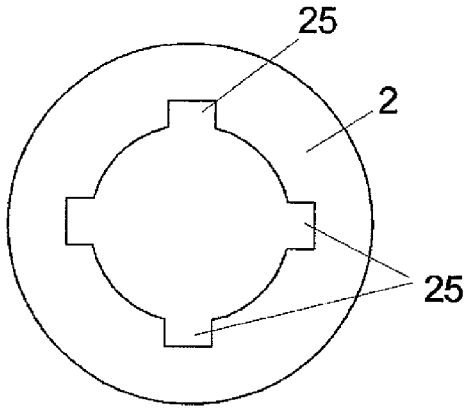
FIG. 6*b* shows a variant for the design of a positive fitting region at a frictional element of the locking device via which the frictional element may be brought in torque-proof and longitudinal moveable engagement with a shaft.

According to FIG. 6*b*, a plurality of such positive fitting regions 25, in the present case for example four positive fitting regions, are arranged one after the other at the inner circumference of the disk-shaped frictional element along the circumferential direction.

Figure 6C:
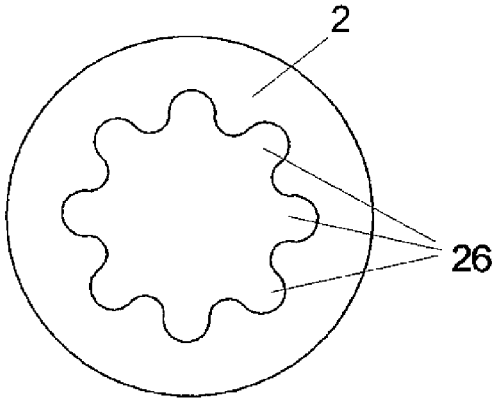
FIG. 6*c* shows a variant for the design of a positive fitting region at a frictional element of the locking device via which the frictional element may be brought in torque-proof and longitudinal moveable engagement with a shaft.
Figure 6D:
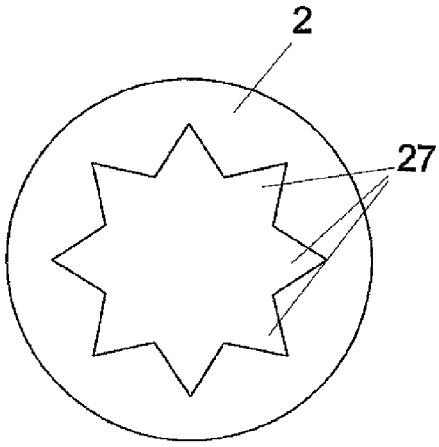
FIG. 6*d* shows a variant for the design of a positive fitting region at a frictional element of the locking device via which the frictional element may be brought in torque-proof and longitudinal moveable engagement with a shaft.

According to FIG. 6*c*, the positive fitting regions 26 being arranged one after the other at the circumference of the disk-shaped frictional element 2 along the circumferential direction in each case have, in cross-section, a rounded shape and, according to FIG. 6*d*, the positive fitting regions 27 are respectively provided, in cross-section, with a triangular shape.

Figure 7A:
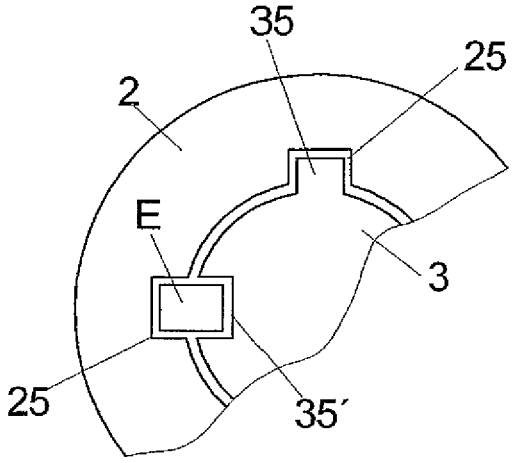
FIG. 7*a* shows a schematic representation of a possible positive connection between a frictional element and a shaft of the locking device on the basis of the variant from FIG. 6*a*.

FIG. 7*a* shows that into a positive fitting region 25 in the form of a groove at the inner circumference of a frictional element 2 a positive fitting region 35 in the form of a spring on the shaft, which spring protrudes from the shaft 3 or, to be precise, from its outer surface and engages into the groove 25, may project.

Likewise, an opposite further groove 35' at the outer surface of the shaft 3 may also be associated to a positive fitting region 25 at the inner surface of the second frictional element 2 which positive fitting region is formed by groove, wherein the connection is then established by a closing member E which is inserted in a hollow space formed by the two grooves 25, 35'.

Figure 7B:
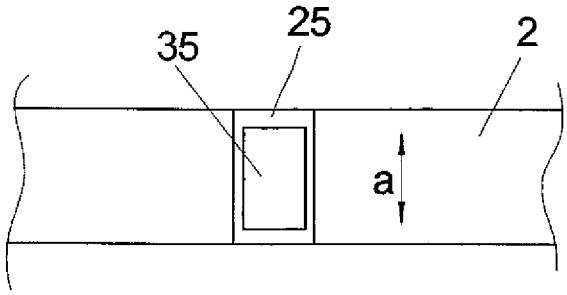
FIG. 7*b* shows a schematic representation of a possible positive connection between a frictional element and a shaft of the locking device on the basis of the variant from FIG. 6*a*.

FIG. 7*b* clearly depicts how a connection which is torque-proof or at least turns with the shaft and which permits a movability of the frictional element 2 in axial direction a may be established with a key and slot joint being formed by a groove-type positive fitting region 25 at the second frictional element 2 and a spring 35 protruding from the shaft 3, by the groove 25 having a greater extent in axial direction a than the spring 35 to be mounted therein, wherein, however, at the same time the spring 35, perpendicular to the axial direction a, is installed substantially immovably, except for an angular play optionally provided for in the associated groove 25.

Naturally, the other way round, at least one groove at the shaft 3 and at least one corresponding spring at the second frictional element 2 may also be provided for, like it is e.g. schematically indicated above in FIGS. 2 to 5.

The invention claimed is:

1. A locking device for securing a motor vehicle component which is displaceable relative to a motor vehicle structure and which is securable by the locking device within a displacement range in a position of rest, the locking device comprising:

a first frictional element; and a second frictional element which is movable relative to the first frictional element and thereby slideable with a friction surface along a friction surface of the first frictional element under sliding friction conditions and wherein, in the position of rest of the motor vehicle component, the friction surface of the first frictional element bears against the friction surface of the second frictional element under static friction conditions, wherein the first frictional element and the second frictional element are pre-tensioned against one another in such a way that they tend to abut one another with their friction surfaces, and at least one of the first frictional element and the second frictional element is mounted in such a way that it is adjustable along an effective direction of pre-tensioning with respect to the other of the first frictional element and the second frictional element, wherein a flowable additional medium is provided which is configured to be brought, upon a relative movement of the frictional elements, between the friction surface of the first frictional element and the friction surface of the second frictional element, wherein the first frictional element comprises an inner wall facing the second frictional element, wherein the inner wall of the first frictional element is conically shaped and defines the friction surface of the first frictional element, and wherein the second frictional element is rotatable with respect to the first frictional element about an axis of rotation and comprises an outer wall facing the first frictional element and extending about the axis of rotation, wherein the outer wall is conically shaped and defines the friction surface of the second frictional element, the second frictional element having an upper circumferential edge bounding the outer wall at an upper side of the second frictional element and at a lower circumferential edge bounding the outer wall towards a lower side of the second frictional element, wherein at least one guide channel is provided at one of the first frictional element and the second frictional element, the at least one guide channel extending substantially along the effective direction of pre-tensioning, and being inclined at an angle to extend substantially parallel to the friction surface of the one of the first frictional element and the second frictional element, wherein the at least one guide channel extends longitudinally between the upper circumferential edge and the lower circumferential edge of the second frictional element and is open at the upper side of the second frictional element and at the lower side of the second frictional element.

2. The locking device according to claim 1, wherein the at least one guide channel is configured to bring the flowable additional medium between the friction surface of the first frictional element and the friction surface of the second frictional element.

3. The locking device according to claim 1, wherein at least one of the first frictional element and the second frictional element is configured to accommodate the flowable additional medium.

4. The locking device according to claim 3, wherein at least one of the first frictional element and the second frictional element is composed of a material configured to accommodate in its molecular structure the flowable additional medium or is composed of a porous material configured to accommodate in its capillary structure the flowable additional medium.

5. The locking device according to claim 3, wherein at least one of first frictional element and the second frictional element comprises a reservoir for the flowable additional medium.

6. The locking device according to claim 1, further comprising a device constituted to increase the static friction being effective, due to the pre-tensioning of the frictional elements, between the friction surface of the first frictional element and the friction surface of the second frictional element bearing against one another.

7. The locking device according to claim 1, wherein the second frictional element is coupled to the displaceable motor vehicle component in such a way that the second frictional element is twisted or moved relative to the first frictional element upon a displacement of the motor vehicle component.

8. The locking device according to claim 1, wherein the second frictional element is configured to be coupled to the displaceable motor vehicle component via a coupling mechanism, wherein the coupling mechanism comprises a shaft to which the second frictional element is connected so as to rotate with the shaft and which is configured to be operatively connected to the motor vehicle component, wherein the second frictional element is connected to the shaft in a positive locking manner such that the second frictional element is mounted, with respect to the shaft, so as to rotate with the shaft and at the same time to be axially movable.

9. The locking device according to claim 8, wherein, for the connection of the second frictional element to the shaft, a key-and-slot joint, a tooth engagement or other positive fitting regions engaging one another are provided.

10. The locking device according to claim 1, wherein the friction surface of the first frictional element and the friction surface of the second frictional element are composed of materials which are selected so that the sliding friction upon a relative movement of the first frictional element and the second frictional element is substantively smaller than the static friction upon stationary bearing of the first frictional element and the second frictional element on each other.

11. The locking device according to claim 1, wherein a ratio of static friction to sliding friction is equal to or greater than 3.

12. A locking device for securing a motor vehicle component which is displaceable relative to a motor vehicle structure and which is securable by the locking device within a displacement range in a position of rest reached by displacement of the locking device, comprising:

a first frictional element; and a second frictional element which is movable relative to the first frictional element and thereby slideable with a friction surface along a friction surface of the first frictional element under sliding friction conditions and wherein, in the position of rest of the motor vehicle component, the friction surface of the first frictional element bears against the friction surface of the second frictional element under static friction conditions, wherein the first frictional element and the second frictional element are pre-tensioned against one another in such a way that they tend to abut one another with their friction surfaces, and at least one of the first frictional element and the second frictional element is mounted in such a way that it is adjustable along an effective direction of pre-tensioning with respect to the other of the first frictional element and the second frictional element, wherein the first frictional element comprises an inner wall facing the second frictional element, wherein the inner wall of the first frictional element is conically shaped and defines the friction surface of the first frictional element, wherein the second frictional element is rotatable with respect to the first frictional element about an axis of rotation and comprises an outer wall facing the first frictional element and extending about the axis of rotation, wherein the outer wall comprises a generally conical shape and defines the friction surface of the second frictional element, the second frictional element having an upper circumferential edge bounding the outer wall at an upper side of the second frictional element and a lower circumferential edge bounding the outer wall towards a lower side of the second frictional element, wherein the friction surface of the second frictional element comprises spherically shaped sections adjoining each other along a circle extending circumferentially about the axis of rotation so that the second frictional element is configured to be brought into engagement with the friction surface of the first frictional element merely via a portion of its friction surface, each spherical section having a radius of curvature smaller than the radius of the circle along which the spherically shaped sections adjoin each other, wherein at least one longitudinally extending guide channel is formed between adjoining spherical sections, extends longitudinally between the upper circumferential edge and the lower circumferential edge of the second frictional element, and is open at the upper side of the second frictional element and at the lower side of the second frictional element.

* * * * *